US008152965B2

(12) United States Patent
Karjunen

(10) Patent No.: US 8,152,965 B2
(45) Date of Patent: Apr. 10, 2012

(54) METHOD AND DEVICE FOR EMPTYING THE FLOOR OF A SODA RECOVERY BOILER

(75) Inventor: Timo Karjunen, Vantaa (FI)

(73) Assignee: Boildec Oy, Vantaa (FI)

( * ) Notice: Subject to any disclaimer, the term of this patent is extended or adjusted under 35 U.S.C. 154(b) by 333 days.

(21) Appl. No.: 12/311,706

(22) PCT Filed: Oct. 5, 2007

(86) PCT No.: PCT/FI2007/050543

§ 371 (c)(1),
(2), (4) Date: Apr. 8, 2009

(87) PCT Pub. No.: WO2008/046959

PCT Pub. Date: Apr. 24, 2008

(65) Prior Publication Data

US 2009/0266277 A1 Oct. 29, 2009

(30) Foreign Application Priority Data

Oct. 18, 2006 (FI) ..... 20065668

(51) Int. Cl.
*D21C 7/00* (2006.01)
*F23G 7/04* (2006.01)

(52) U.S. Cl. ..... 162/240; 162/48; 162/272; 110/238; 110/259; 202/241; 202/261

(58) Field of Classification Search ..... 162/17, 162/48, 52, 199, 239, 240, 246, 272, 29, 162/30.1, 30.11, 31–39; 15/104.05; 159/43.1; 134/21, 22.1; 202/241, 261; 422/185; 266/238; 414/147; 110/238, 259
See application file for complete search history.

(56) References Cited

U.S. PATENT DOCUMENTS

| | | | | |
|---|---|---|---|---|
| 124,700 | A | 3/1872 | Sellers | |
| 461,429 | A | 10/1891 | Frasch | |
| 1,670,156 | A | 5/1928 | Howell, Jr. | |
| 1,866,682 | A | 7/1932 | Temmen | |
| 2,030,560 | A | 2/1936 | Adams, Jr. | 103/93 |
| 2,091,829 | A | 8/1937 | Nelson | 262/3 |

(Continued)

FOREIGN PATENT DOCUMENTS

CA 1078559 A1 5/1979

(Continued)

OTHER PUBLICATIONS

Henrk Ryti: Koneoppi, osa 1. Staattiset koneet, Espoo, Finland 1979, pp. 361-367.

(Continued)

*Primary Examiner* — Eric Hug
*Assistant Examiner* — Peter Chin
(74) *Attorney, Agent, or Firm* — Harrington & Smith

(57) ABSTRACT

The invention is related to a method for emptying a furnace floor in a soda recovery boiler when the soda recovery boiler is being shut down. The emptying may be started while smelt is still flowing in smelt spouts. The floor is emptied by sucking smelt from the furnace with a smelt eductor. The invention is also related to a device for removing smelt and wash water from a furnace of a soda recovery boiler by means of suction. Negative pressure is generated in the device by conducting pressurized gas into a suction pipe of the eductor so that the pressurized gas is discharged in the discharge direction of smelt and wash water.

18 Claims, 3 Drawing Sheets

U.S. PATENT DOCUMENTS

| | | | | | |
|---|---|---|---|---|---|
| 2,137,619 | A | | 11/1938 | Lee | 262/3 |
| 2,210,544 | A | | 8/1940 | Galloway | 22/209 |
| 2,391,443 | A | * | 12/1945 | Bruton | 201/2 |
| 2,948,524 | A | | 8/1960 | Sweeney et al. | 266/38 |
| 3,211,545 | A | | 10/1965 | Sickbert et al. | 75/49 |
| 3,291,473 | A | | 12/1966 | Sweeney et al. | 266/38 |
| 3,440,026 | A | | 4/1969 | Dubow | 23/308 |
| 3,630,573 | A | | 12/1971 | Goddin, Jr. et al. | 299/6 |
| 3,632,096 | A | | 1/1972 | Perry | 266/37 |
| 3,667,879 | A | | 6/1972 | Cerpelli | 418/202 |
| 3,776,660 | A | | 12/1973 | Anderson et al. | 415/196 |
| 3,867,132 | A | | 2/1975 | Perry | 75/49 |
| 4,011,047 | A | | 3/1977 | Tremblay | 23/252 R |
| 4,105,438 | A | | 8/1978 | Sherwood | 75/49 |
| 4,249,775 | A | | 2/1981 | Zakiewicz | 299/4 |
| 4,456,476 | A | | 6/1984 | Sherwood | 75/46 |
| 4,462,319 | A | | 7/1984 | Larsen | 110/238 |
| 4,628,828 | A | | 12/1986 | Holtham et al. | 110/165 R |
| 4,750,649 | A | | 6/1988 | Fahey et al. | 222/592 |
| 4,808,264 | A | | 2/1989 | Kignell | 162/30.1 |
| 4,869,555 | A | | 9/1989 | Peters et al. | 299/7 |
| 4,878,441 | A | | 11/1989 | Ryham | 110/238 |
| 4,938,276 | A | | 7/1990 | Noguchi et al. | 164/133 |
| 5,121,869 | A | | 6/1992 | Knudsen et al. | 228/4.1 |
| 5,203,681 | A | | 4/1993 | Cooper | 417/424.1 |
| 5,305,990 | A | | 4/1994 | Sherwood | 266/45 |
| 5,355,844 | A | | 10/1994 | Kendrick | 122/390 |
| 5,437,768 | A | * | 8/1995 | Smith et al. | 162/239 |
| 5,441,390 | A | | 8/1995 | Rapp et al. | 417/359 |
| 5,478,440 | A | | 12/1995 | Paju | 162/30.1 |
| 5,509,791 | A | | 4/1996 | Turner | 417/238 |
| 5,635,095 | A | | 6/1997 | Kleinfeld | 222/590 |
| 5,976,319 | A | | 11/1999 | Paju et al. | 162/30.1 |
| 6,287,415 | B1 | | 9/2001 | Salmi et al. | 162/30.1 |

FOREIGN PATENT DOCUMENTS

| | | | |
|---|---|---|---|
| DE | 605701 | | 11/1934 |
| DE | 195 41 093 | A1 | 5/1997 |
| FI | 107461 | B | 8/2001 |
| GB | 848572 | A | 9/1960 |
| GB | 1 390 636 | | 4/1975 |
| GB | 1390636 | A | 4/1975 |
| GB | 2337085 | A | 11/1999 |
| JP | 60050380 | A | 3/1985 |
| JP | 62047468 | A | 3/1985 |
| WO | WO-99/27180 | A1 | 6/1999 |
| WO | WO-2008046959 | A1 | 4/2008 |

OTHER PUBLICATIONS

"Pumput, Nesteiden siirtoon kaytettyjen pumppujen ryhmittely ja toimintaperiaatteet", SFS 4874 Suomen Stardardisoimisliitto, Dec. 31, 1982, 10 pgs.

"Pump Users Handbook", Rayner, R., 1995, 3 pgs.

"Ballast Eductors", Schutte & Koeting, Chemical Tanker Notes, 2006, 2 pgs.

Salzschmelze, "Pumps for moving molten salts", Friatec AG 3.00. 0014-1008 d-e-f, 4 pgs.

"Recovery Boiler Training Course", The Employers' Federation of Swedish Forest Industries, 1982, 4 pgs.

* cited by examiner

METHOD AND DEVICE FOR EMPTYING THE FLOOR OF A SODA RECOVERY BOILER

FIELD OF THE INVENTION

The invention is related to the emptying of the floor of a soda recovery boiler. In particular, but not solely, the invention is related to the emptying of salty smelt and/or wash water from the soda recovery boiler when the boiler is being shut down.

BACKGROUND OF THE INVENTION

A soda recovery boiler is used for combusting waste liquor generated in connection with pulp manufacture, containing various sodium salts besides organic matter and water. During the operation of the boiler these salts form a smelt pool on the furnace floor, from which smelt continuously flows through smelt spouts to a dissolving tank. The smelt spouts are typically located approximately 250 mm above the level of the furnace floor. Typically, there is a smelt layer of at least approximately 300 mm on the furnace floor continuously during operation.

When the soda recovery boiler is shut down for maintenance, for example, the furnace floor remains covered with smelt. When the floor cools down the smelt solidifies and forms a hard "cake", which must be removed by water washing or by chiseling if the aim is to clean the floor for maintenance work or inspections. The cleaning of the floor significantly extends the shutdown period, so a method and apparatus for removing smelt from the furnace by pumping have been developed in order to save time, as disclosed in the Finnish patent application no. 974206. The pumping is started in a situation where the surface of the salty smelt has reached the level of the lower edge of the smelt spout opening when the boiler is being shut down. Heating of the smelt is continued with a gas or oil flame and a spiral pump is used for the pumping.

When using a spiral pump the smelt is pumped from the furnace floor using a straight pipe having a pipe mouth at one end and a pump drive at the other end. There is a curved portion around the middle of the pipe, forming a discharge pipe through which the salty smelt is discharged from the pipe. In soda recovery boilers where the floor profile is such that the smelt pool is at its deepest close to the smelt spouts, it may not be possible to pump smelt from the deepest location of the pool with a spiral pump; rather, a considerable amount of smelt may, in many cases, remain on the furnace floor after the pumping. This extends the time needed for water washing and thus slows down the shutting down of the boiler. Another problem associated with the use of spiral pumps is that their installation requires a fairly long period of work in the immediate vicinity of the smelt spouts.

SUMMARY

In accordance with a first aspect of the invention, there is provided a method for emptying the floor of a soda recovery boiler when the boiler is being shut down, the method comprising:

sucking smelt from the soda recovery boiler with a suction device through an opening arranged in a wall of the boiler.

In accordance with an embodiment of the invention, negative pressure used for eduction is generated in the suction device and the smelt is sucked based on negative pressure suction.

The smelt eductor used in accordance with an embodiment of the invention is, as such, a non-mechanical device. The suction is generated by means of gas discharged at high speed, for example. In an embodiment gas is conducted into the suction device and further made to move within the suction device in the discharge direction of the suction device. In an embodiment the gas at first tends to draw with it surrounding gas due to friction and soon afterwards (when the smelt eductor starts to operate in the proper meaning of the word) draws smelt from the soda recovery boiler.

In an embodiment of the invention said opening is a smelt spout opening or another opening arranged for the purpose of emptying. In an embodiment of the invention smelt is sucked with a smelt eductor whose suction pipe is throughout substantially hollow and free of obstacles.

In an embodiment of the invention smelt is sucked with a smelt eductor from a furnace of a soda recovery boiler into a smelt spout, either directly or through the smelt spout into a smelt tank or a dissolving tank, or into another collection system. Said smelt to be sucked may be salty smelt or wash water, for example. In an embodiment of the invention the start of the emptying is advanced so, that the emptying of the floor is started while smelt still flows in the smelt spouts. If, at this time, there is still unmolten salt on the floor in the corners of the furnace, for example, the melting of the salt may be continued simultaneously by spraying black liquor into the furnace and adjusting the spraying of the black liquor so that the black liquor sprays distribute evenly throughout the furnace floor.

In an embodiment of the invention the eduction of the smelt is continued until the furnace floor has been thoroughly emptied of salty smelt. In an embodiment of the invention, if the black liquor tank becomes empty before the smelt pool on the furnace floor is empty, heating of the floor is continued solely with oil or gas burners. The start of the eduction may be scheduled to start so early that the period during which the heating of the salt on the floor solely depends on gas or oil burners remains so short that the salty smelt does not have time to solidify before the floor is emptied.

In an embodiment of the invention the shutting down of the boiler is accelerated by positioning and designing the eductors so that smelt is sucked from the deepest location of the smelt pool, whereby the floor can be emptied more completely. Due to this, the boiler cools down more rapidly after the emptying of the floor, whereby the start of water washing of the furnace and superheaters located in the upper portion of the furnace may be advanced.

In accordance with another aspect of the invention, there is provided a suction device for emptying a floor of a soda recovery boiler when the boiler is being shut down, which suction device is adapted to be installed in an opening arranged in a wall of the soda recovery boiler, and that the suction device comprises: a mechanism for generating suction with which smelt is sucked from the soda recovery boiler.

In an embodiment of the invention a smelt eductor is used as the suction device, comprising a suction pipe having a suction end and a discharge end, which suction pipe is arranged to suck smelt through the suction end from a furnace of a soda recovery boiler, and the discharge end is arranged to discharge smelt from the eductor.

In an embodiment of the invention the suction device is designed in such a way that, when installed in place in the opening in the boiler, it will be positioned so that the suction end of the suction pipe is in a deep location of a smelt pool close to the floor and the discharge end discharges smelt into a smelt spout or directly into a discharge tank. In an embodiment of the invention the suction device is formed so that conforms to the smelt spout of the soda recovery boiler.

In an embodiment of the invention at least one bend is arranged in the suction pipe of the suction device, the angle of which determines the positions of the suction end and the discharge end. The portion of the suction pipe between the suction end and the bend forms a cam-like part with which smelt can be sucked from the desired location on the furnace floor. When the eductor is installed in the opening in the wall of the soda recovery boiler, the cam-like part is adapted to limit the movement of the eductor in the longitudinal direction of the eductor.

In an embodiment of the invention the smelt eductor is configured to generate negative pressure suction in a manner in which pressurized gas is conducted into the eductor from a pressurized gas connection comprised by the eductor so that the gas is discharged in the discharge direction of the eductor. The eductor may comprise a pressurized gas pipe attached to the suction pipe by welding, for example, which pressurized gas pipe may be used as an installation arm, holding which the eductor may be pushed in place in the opening in the boiler wall.

In an embodiment of the invention the pressurized gas pipe is smaller in diameter than the suction pipe and welded to the suction pipe so that it extends within the suction pipe and points towards the discharge end.

In an embodiment of the invention is used a smelt eductor based on negative pressure suction that can be safely installed in place even while smelt flows in the smelt spouts and which is not susceptible to mechanical failures as there are no moving parts in the suction pipe of the device.

Various embodiments of the invention will be or have been described only in connection with one or some of the aspects of the invention. However, the embodiments may also be applicable to other aspects of the invention, and vice versa.

SHORT DESCRIPTION OF THE DRAWINGS

In the following, the invention will be described by way of example with reference to the appended drawings, in which.

DETAILED DESCRIPTION

It should be noted that the figures shown are not entirely to scale, and primarily serve to illustrate embodiments of the invention.

Figure 1:
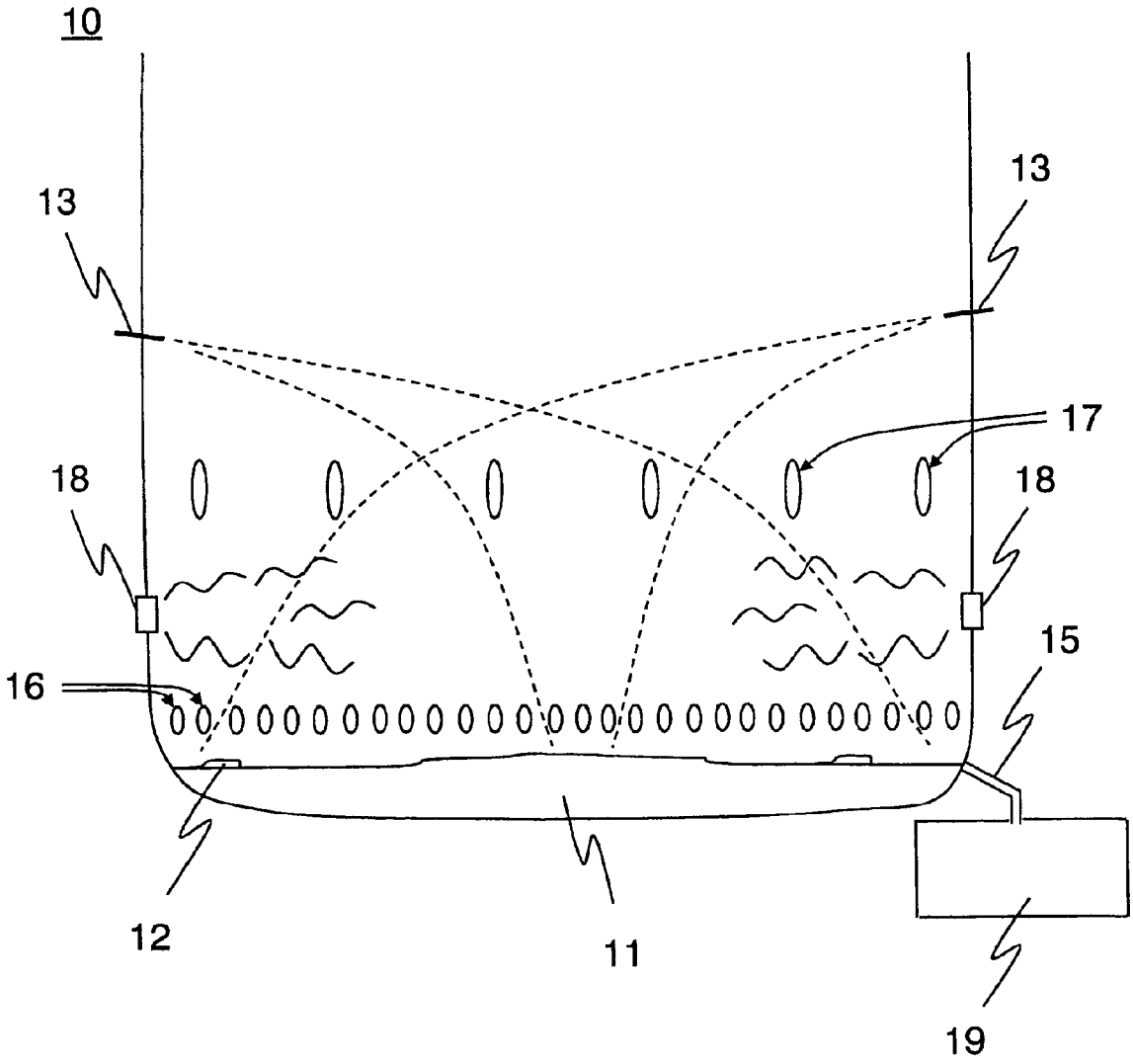
FIG. 1 shows a cross-section of a soda recovery boiler.

FIG. 1 shows a cross-section of a soda recovery boiler 10 in the area of a furnace of the soda recovery boiler. There is a partly molten salty pool 11 and smelt deposits 12 on the floor of the boiler. Black liquor is sprayed into the boiler with black liquor spray nozzles 13, typically from openings in all four walls so that, when the boiler is fully loaded, there are typically 6 to 10 spray nozzles in use, depending on the size of the boiler. The black liquor spray openings are typically at a height of 6 to 7 meters from the floor. The combustion of the black liquor in the furnace of the boiler is controlled by conducting air into the boiler from primary air openings 16, secondary air openings 17 and tertiary air openings (not shown). The salty smelt forming on the floor flows from the salty pool 11 through smelt spouts 15 to a dissolving tank 19.

In a method in accordance with an embodiment of the invention an aim is to first melt the smelt on the furnace floor in its entirety when the soda recovery boiler is being shut down by combusting black liquor and auxiliary fuel simultaneously, the auxiliary fuel commonly being oil or gas. The auxiliary fuel is combusted with start burners 18 installed on the walls of the boiler (FIG. 1).

The spraying of the black liquor is adjusted so that the black liquor sprays are distributed evenly throughout the furnace floor, Whereby smelt deposits on the edges of the furnace can also be melted. The adjustment can be implemented, for example, by always using spray nozzles positioned at opposite sides of the boiler when the boiler is being shut down in order to provide symmetrical melting. An example case involves using two black liquor spray nozzles, whereby the valves of the black liquor line are kept open for black liquor spray nozzles on two opposite walls. Alternatively or additionally, the direction and pressure of the black liquor nozzles may be adjusted so that the black liquor is distributed throughout the floor and the black liquor forms droplets effectively. The selection and control mechanism for the black liquor spray nozzles to be used is, as such, known to persons skilled in the art.

In an embodiment of the invention the combustion of the black liquor is adjusted while the boiler is being shut down by controlling the amount and distribution of combustion air so that a sufficient amount of primary air is conducted into the furnace compared to the flows of secondary and tertiary air as well as black liquor and auxiliary fuel so that the black liquor is mainly combusted in the lower part of the furnace. Thereby the combustion of the black liquor heats the salt on the floor more efficiently than gas flames, for example, the heat of which is more poorly conveyed to the floor. The control mechanism for the amount and distribution of combustion air is, as such, known to persons skilled in the art.

When the smelt on the floor is entirely or partly molten and a suitable amount of black liquor remains in the black liquor tank (not shown), the emptying of the floor is started by installing smelt eductors in the openings in the walls of the boiler and opening valves of pressurized gas lines leading to the eductors. The flow of the black liquor is adjusted so that the smelt eductors remove a larger amount of smelt from the furnace floor than the amount of salt carried to the furnace with the black liquor, whereby the smelt pool on the furnace floor begins to empty. This is continued until the black liquor tank is empty. After this, the heating of the floor is continued solely with the oil or gas burners 18 (FIG. 1).

The eduction of the smelt is continued until the floor is emptied of salt so that the mouths of the suction ends of the eductors are partly revealed, at which point the suction is no longer sufficient to remove the smelt. After this, the smelt eductors may be removed for maintenance.

Figure 2:
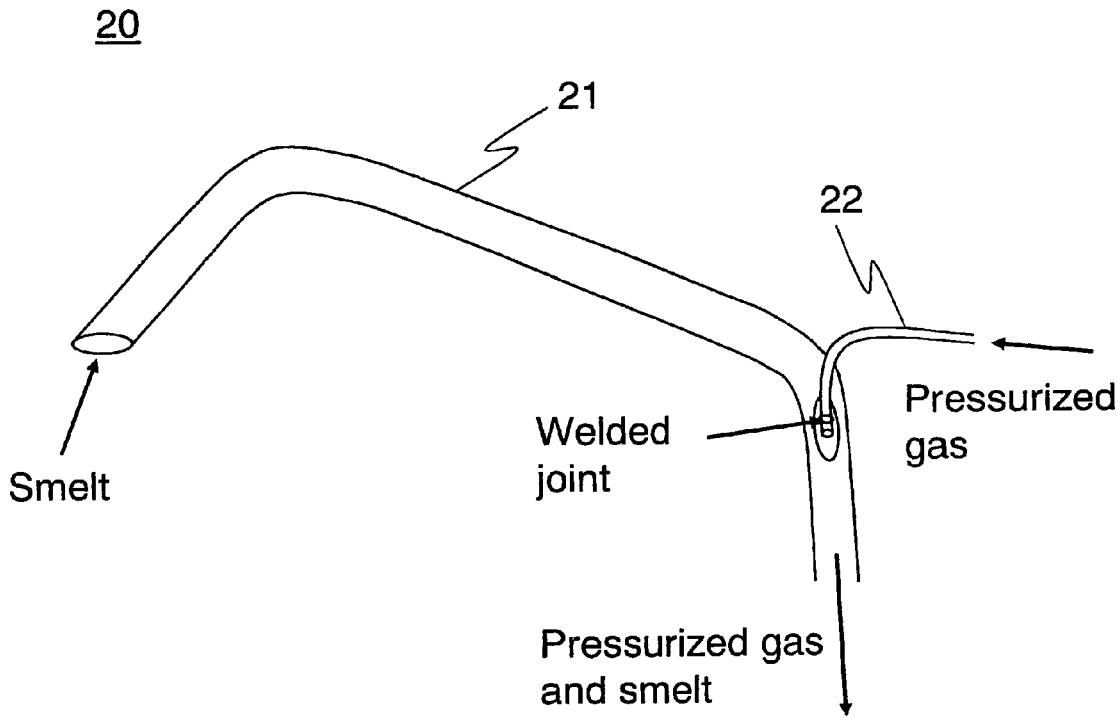
FIG. 2 shows a smelt eductor in accordance with an embodiment of the invention.

FIG. 2 shows an example of a smelt eductor suitable for smelt eduction. Negative pressure is generated in the eductor 20 by conducting pressurized gas into the eductor through a smaller pipeline 22. The pressurized gas line 22 is fitted to the eductor 20 so that the pressurized gas is discharged to the discharge side of the eductor.

As shown in FIG. 2, the eductor 20 comprises a suction pipe 21 and a pressurized gas pipe 22, which are made from acid-proof steel, for example. In an example case the outer diameter of the suction pipe 21 is 76 mm and the thickness of the pipe wall is 3 mm. The outer diameter of the pressurized gas pipe 22 is 15 mm and the thickness of the pipe wall is 1 mm. In an example case the suction pipe 21 is welded from three rectilinear parts and two bends so that the lengths of the rectilinear parts are 300 mm, 750 mm and 250 mm, respectively, and the parts are joined by bends of 100° and 112°, respectively. The discharge end of the eductor consists of a rectilinear pipe of 250 mm in length with a hole bored in the preceding 112° bend, in which hole the pressurized gas pipe 22 is fitted by welding so that the pressurized gas pipe 22 is within the suction pipe 21 in the direction of the center line of the rectilinear pipe forming the discharge end of the suction pipe 21 and the discharge end of the pressurized gas pipe 22 is at the level of the discharge side of the bend. The pressurized gas is thus discharged in the discharge direction of the eductor 20 thereby generating suction that removes the smelt or water from the furnace. At the same time, the pressurized gas breaks down the smelt flow into droplets so that no separate breaking down with steam jets is necessarily needed.

The pressurized gas pipe (or a pressurized air connection) may be designed and supported so that it simultaneously serves as an installation arm for the eductor, holding which the eductor may be pushed in place. Alternatively, a special installation arm (not shown) may be fitted to the eductor (by welding, for example), holding which the eductor 20 may be installed in the smelt spout opening or another installation opening in the wall of the black liquor boiler.

The pressurized gas required for the eductor 20 may be taken from a low-pressure steam line or pressurized air system (not shown) used at the mill. The pressurized gas pipe 22 is connected to the mill's steam or pressurized gas network with a pressure hose equipped with suitable fittings.

Figure 3:
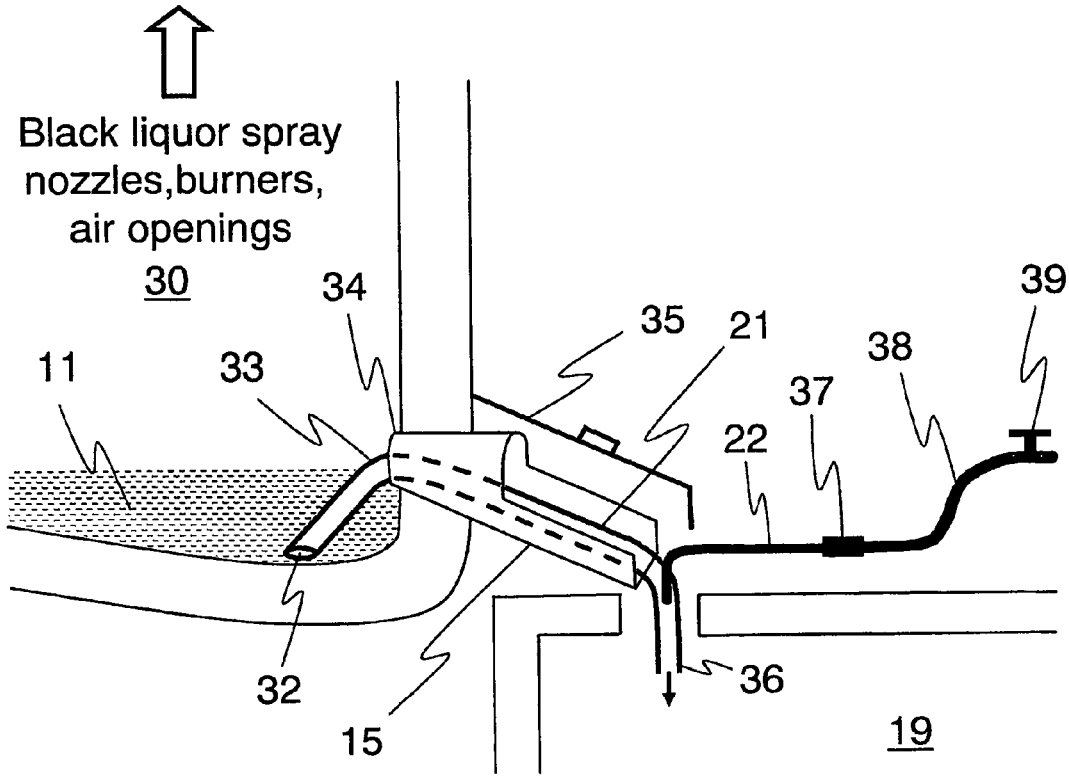
FIG. 3 shows the smelt eductor in accordance with an embodiment of the invention installed in place.

FIG. 3 shows the smelt eductor 20 shown in FIG. 2 installed in place. In the example case, the suction pipe 21 of the eductor is installed in the smelt spout 15, whereby the suction end of the eductor is pushed from the smelt spout opening into the smelt pool 11 on the furnace 30 floor, below the surface of the pool and close to the floor. In an embodiment of the invention the smelt eductor is designed so that it conforms to the smelt spout 15. In an embodiment of the invention the mouth 32 of the suction end is designed so that it is in a substantially horizontal plane in its operating position in order to improve suction. The part of the suction pipe 21 between the bend 33 and the mouth 32 of the suction end is designed so that it reaches the desired location on the furnace floor. In an embodiment of the invention this bent part serves to prevent lateral movement of the eductor and tilting of the eductor to one side as the tip of the bent part tends to fall downward. The pressurized gas connection entering the eductor may also serve to prevent lateral movement. If there is a hood with a hinged cover 35 above the smelt spout 15, it may serve to prevent lateral movement of the smelt eductor. Typically, the hood 35 has the same width as the smelt spout 15. The edges of the hood 35 limit the margin for lateral movement of the pressurized gas connection.

In an embodiment of the invention the smelt spout 15 comprises a part that forms a collar 34 in the smelt spout opening in the wall of the furnace 30. In the example case illustrated in FIG. 3, the bent part between the bend and the suction end (or the bend 33) rests on the edge of the smelt spout collar 34 when the smelt eductor is installed in the opening. The part of the suction pipe 21 extending from this point towards the discharge end rests on the remaining part of the smelt spout 15. In other words, the smelt spout 15 forms a support surface which the smelt eductor rests on and which keeps the smelt eductor in place.

In the embodiment shown in FIG. 3 the smelt falls from the opening at the discharge end 36 of the eductor directly into the dissolving tank 19. Alternatively, the eductor may be shorter and/or the bend on the side of discharge end may be omitted. In this case, for example, the smelt may be discharged from the eductor first into the smelt spout 15 and through the smelt spout into the dissolving tank 19.

When the smelt eductor has been installed in place, it is taken into use by connecting the pressurized gas pipe 22 with suitable fittings 37 to a pressurized gas line 38 and opening a valve 39 in the pressurized gas line so that the gas being discharged into the eductor generates the negative pressure used for eduction. The valve 39 of the pressurized gas line may be located far from the eductor, whereby the use of the eductor does not require working in its immediate vicinity.

In alternative embodiments of the invention the emptying of the floor of the soda recovery boiler is implemented in ways that deviate from the above. For example, instead of the smelt spouts, the eductor may be installed in openings made in the walls of the furnace particularly for the purpose of emptying the floor, located above the surface of the smelt pool close to the location where smelt pool on the floor is at its deepest. Thereby the eductor will more easily reach the deepest location of the smelt pool and the floor can be emptied of salt practically completely.

Besides for removing salty smelt, the smelt eductor described above is also suitable for removing wash water collected on the furnace floor when the boiler is water washed. When removing wash water, the eductor is, in principle, installed in the same way as when removing smelt. Instead of the smelt pool, the suction end is pushed into a water pool formed in the boiler.

The shape and size of the suction pipe and the pressurized gas pipe of the eductor may be altered in order to adapt the power of the eductor to each particular need and existing structures. In addition, instead of connecting the eductor directly to the smelt spout or dissolving tank, depending on the purpose of use, the eductor may be connected to a pipe extension, through which the smelt flows to the dissolving tank or another collection system.

Alternative materials for the eductor may include, among other materials, various steels that can resist high temperatures as well as erosion and corrosion caused by the smelt better than acid-proof steel.

The above description provides non-limiting examples of some embodiments of the invention. However, it is apparent to a person skilled in the art that the invention is not limited to the details presented; rather, the invention may also be implemented in other equivalent ways. The methods and the smelt eductor described may also be used for sucking salty smelt in other possible industrial processes where salty smelt is generated. For the purposes of this document, the terms "comprise" and "include" are open-ended and are not intended to be limiting.

Some characteristics of the embodiments disclosed may be utilized without using the other characteristics. The above description, as such, should be regarded as a descriptive presentation of the principles of the invention and not as limiting the invention. Therefore, the scope of the invention is only limited by the appended claims.

The invention claimed is:

1. A method for emptying a floor of a soda recovery boiler when the boiler is being shut down, the method comprising:

generating, in a suction device, negative pressure suction used for eduction, and sucking smelt from the soda recovery boiler with the suction device based on the negative pressure suction through an opening arranged in a wall of the soda recovery boiler.

2. A method as claimed in claim 1, wherein said opening is a smelt spout opening arranged for emptying the soda recovery boiler.

3. A method as claimed in claim 1, wherein sucking smelt comprises a smelt eductor of the suction device sucking the smelt, based on the negative pressure suction, from a furnace of the soda recovery boiler.

4. A method as claimed in claim 3, wherein generating the negative pressure suction comprises conducting pressurized gas into the smelt eductor so that the gas is discharged in a discharge direction of the eductor.

5. A method as claimed in claim 1, wherein sucking smelt comprises a smelt eductor of the suction device sucking the smelt from a furnace of the soda recovery boiler into:

a smelt spout; and directly or through the smelt spout to a smelt tank or a dissolving tank; or another collection system.

6. A method as claimed in claim 1, which method comprises:

starting emptying of the soda recovery boiler at a point of time when a smelt surface level in the boiler is such that smelt still flows in a smelt spout.

7. A method as claimed in claim 1, wherein the method comprises installing a smelt eductor in an opening in a boiler wall so that a suction pipe comprised by the smelt eductor extends below a level of the opening into a smelt pool on a floor of a furnace in the boiler.

8. A method as claimed in claim 7, wherein the method comprises a mouth of the suction pipe being positioned close to a deepest location on the floor of the boiler.

9. A method as claimed in claim 1, wherein the method comprises a smelt eductor of the suction device fitting at least partially inside a smelt spout of the soda recovery boiler.

10. A method as claimed in claim 1, wherein the method comprises sucking smelt with a smelt eductor whose suction pipe is throughout substantially hollow and free from obstacles.

11. An apparatus comprising:

a soda recovery boiler; and a suction device for emptying a floor of the soda recovery boiler when the boiler is being shut down, the suction device comprising:

a suction pipe adapted to be installed in an opening arranged in a wall of the boiler, and a mechanism for generating negative pressure suction in the suction pipe, where the mechanism and the suction pipe are adapted to suck smelt from the soda recovery boiler.

12. An apparatus as claimed in claim 11, wherein the suction device is a smelt eductor comprising the suction pipe, where the suction pipe comprises a suction end and a discharge end and is arranged to suck smelt with the suction end from a furnace of the soda recovery boiler, and the discharge end is arranged to discharge smelt from the smelt eductor.

13. An apparatus as claimed in claim 12, where the suction device is formed so that, when installed in said opening, the suction device will be positioned so that the suction end of the suction pipe is at a deep location of a smelt pool close to the floor and the discharge end discharges smelt into a smelt spout or directly into a dissolving tank or another collection system.

14. An apparatus as claimed in claim 11, wherein at least one bend is arranged in the suction pipe, where an angle of the at least one bend determines a position of the suction pipe in the furnace of the boiler.

15. An apparatus as claimed in claim 11, where the suction device is configured to generate negative pressure suction in a mariner where pressurized gas is conducted within the suction device from a pressurized gas connection so that the gas is discharged in the discharge direction of the suction device.

16. An apparatus as claimed in claim 11, where the suction device comprises a pressurized gas pipe, where the pressurized gas pipe is connected to the suction pipe, where the pressurized gas pipe is adapted to push the suction pipe in place in the opening, where the pressurized gas pipe is adapted to function as an installation arm.

17. An apparatus as claimed in claim 16, wherein the pressurized gas pipe is smaller in diameter than then the suction pipe and is welded to the suction pipe so that the pressurized gas pipe extends within the suction pipe and points towards a discharge end of the suction pipe.

18. An apparatus as claimed in claim 11, where the suction pipe comprises a cam-like part, where the cam-like part is adapted to prevent the suction device from being pulled from the opening in the wall of the furnace when a level of a smelt pool is above a level formed by a lower edge of the opening.

* * * * *

UNITED STATES PATENT AND TRADEMARK OFFICE

CERTIFICATE OF CORRECTION

PATENT NO. : 8,152,965 B2
APPLICATION NO. : 12/311706
DATED : April 10, 2012
INVENTOR(S) : Karjunen It is certified that error appears in the above-identified patent and that said Letters Patent is hereby corrected as shown below:

Claim 15, col. 8, line 23 delete “mariner” and insert --manner--.

Signed and Sealed this
Third Day of July, 2012

David J. Kappos

David J. Kappos
*Director of the United States Patent and Trademark Office*